US007333027B2

(12) United States Patent
Bourgault

(10) Patent No.: US 7,333,027 B2
(45) Date of Patent: Feb. 19, 2008

(54) POWER SUPPLY FOR LED SIGNAL

(75) Inventor: Jean Simon Bourgault, Lachine (CA)

(73) Assignee: Lumination LLC, Valley View, OH (US)

( * ) Notice: Subject to any disclaimer, the term of this patent is extended or adjusted under 35 U.S.C. 154(b) by 0 days.

(21) Appl. No.: 11/014,103

(22) Filed: Dec. 15, 2004

(65) Prior Publication Data

US 2006/0125418 A1 Jun. 15, 2006

(51) Int. Cl.
*G08G 1/095* (2006.01)

(52) U.S. Cl. ..... 340/907; 340/931; 340/468; 340/469; 340/815.45; 315/291; 315/224; 315/200 A

(58) Field of Classification Search ..... 315/77, 315/82, 291, 224, 200 A, 312, DIG. 4; 340/457.2, 340/468, 469, 641, 907, 931, 660–664, 815.45; 362/800, 475; 307/10.8, 112
See application file for complete search history.

(56) References Cited

U.S. PATENT DOCUMENTS 5,457,450 A * 10/1995 Deese et al. ..... 340/912
5,850,126 A * 12/1998 Kanbar ..... 315/200 A
6,150,771 A * 11/2000 Perry ..... 315/291
6,717,526 B2 * 4/2004 Martineau et al. ..... 340/815.45
6,858,994 B2 * 2/2005 Vollrath ..... 315/200 A

* cited by examiner

*Primary Examiner*—Haissa Philogene
(74) *Attorney, Agent, or Firm*—Fay Sharpe LLP

(57) ABSTRACT

A power supply for a Light Emitting Diode (LED) traffic signal that controls the light intensity. The light intensity conforms to a predetermined pattern based on the input voltage root mean square value ($V_{rms}$). The input voltage is changed by acting on the amplitude of the sine wave or by using a triac and controlling the angle of fire. The power supply comprises a fuse module, an electromagnetic compatibility filter module, a power supply module, a LED load module, a current monitor module, a RMS-DC conversion module and a fuse blow out module.

27 Claims, 11 Drawing Sheets

POWER SUPPLY FOR LED SIGNAL

BACKGROUND OF THE INVENTION

1. Field of the Invention

The present inventions relates to traffic signals. More particularly, the present invention relates to power supplies for light emitting diode (LED) traffic signals.

2. Description of the Related Art

Traffic signal lamps typically use either incandescent or LED lamps. LED traffic signals are more reliable, more mechanically stable, safer, more energy efficient and more environmentally friendly than incandescent lamps. Thus, LED traffic signals are gaining in popularity.

LED traffic signals are typically used as a replacement for an incandescent bulb traffic signals. They may also be used in new traffic installations. Driven by stable current and voltage levels produced by switching power supplies, LED traffic signals consume relatively low amounts of power and have extremely long lifetimes compared to standard incandescent bulbs. Whether the signals is being retrofit into an existing traffic signal or is part of a new installation, the LED lighted traffic signals must meet governmental standards.

Governments regulate many aspects of the signal including chromaticity requirements, electromagnetic compatibility (EMC) requirements, controller capability requirements, sun phantom protection requirements, and photometric requirements such as dimming compatibility and brightness. However, there is no worldwide standard for traffic lights. Different requirements exist for the United States, for Europe and for Australia and New Zealand. Other differences include that the operating range of the Australia signal lamp is larger. Australian signals have a requirement related to the shape of the input current within ±500 microsecond of the peak input voltage. Australian traffic controllers utilize dimming in low light conditions. Preferably, linear dimming is utilized.

Further, because LED signals lamps are often retrofit into units originally housing incandescent traffic lamps, it is necessary to provide circuitry that is compatible with existing signals and that it mimics the way an incandescent signal behaves. A signal light that meets the governmental requirements and mimics the behavior of an incandescent signal is needed.

SUMMARY OF THE INVENTION

It is desirable for a traffic lamp to dim in low ambient light conditions. However, when dimmed the lamp must still meet minimum light output standards. Circuitry is needed to perform these functions and to perform them in a way that meets the governmental standards and mimics the behavior of a conventional incandescent signal.

The present invention is a novel way to control the light intensity of a LED traffic signal to conform to a predetermined pattern, depending on the input voltage root mean square (RMS) value. The input voltage is changed by acting on the amplitude of the sine wave or by using a triac and controlling the angle of fire. The traffic signal power supply system diminishes the light output to an established level during low light conditions. The dimmed light output must be sufficient to compensate for the ambient light.

The power supply comprises of the following modules: fuse module, electromagnetic compatibility (EMC) filter module, power supply module, LED load module, current monitor module, RMS-to-DC conversion module, and fuse blowout module.

The fuse module contains the fuses for the power supply circuit. It also contains a device to protect the circuitry and the lamp from over-voltage on the AC line coming into the lamp.

The EMC filter module contains an arrangement of X2- and Y-capacitors, inductors and common mode chokes to reduce conducted electromagnetic emissions. All components are properly de-rated to ensure that the voltage or current applied is never above the manufacturer's rating.

The power supply module takes the AC voltage from the input and transforms it into DC voltage, with a regulated current, to power the LEDs. A switching power supply is used. This power supply uses a flyback converter. The power supply is designed to operate within the operating range of the lamp, preferably from about $100V_{ac}$ to about $285V_{ac}$ at 50 Hz. The power supply module has a variable duty cycle so that the signal coming from the current monitor is always the same.

The LED load module comprises one or more LED. If the load comprises a plurality of LEDs, the LEDs are preferably connected in a series-parallel arrangement. If one LED suffers from a catastrophic failure, only the affected LED will shut down. The current will be equally spread among the remaining parallel LEDs. As a result, the remaining LEDs and, thus, the lamp will remain lit.

The LEDs are mounted on a printed circuit board. Metal core printed circuit boards are used for some lamps such as the yellow 300 mm disc and the yellow 300 mm arrow. Other lamps may use high quality glass epoxy printed circuit boards FR4. The number of LEDs may vary based on the color of the signal, size of the signal and/or type of LED.

The current monitor module reads the current flowing through the LEDs and reports the value to the power supply controller. The current monitor module is acted upon by the RMS-to-DC module to change the light intensity. The gain of the reading is modified to change the current flowing through the LEDs.

The RMS-to-DC module and the fuse blow out modules incorporate a microcontroller that monitors the input voltage and the current flowing in the LEDs. The input voltage is sampled at 23 kHz. This sampling rate can detect a phase controlled signal that varies by as little as 1 degree at 60 Hz. The microcontroller preferably uses a true RMS-to-DC algorithm. Whatever the shape of the input voltage, the microcontroller computes the RMS value of the input voltage ($V_{rms}$) and averages it over a specified time. The current monitor gain is adjusted to closely follow the intensity vs. $V_{rms}$ graph provided in the Australian Standard for Traffic Signal Lanterns—AS/NZS 2144. Based on the RMS value calculated, a voltage controlled current source is acted upon. The microcontroller also turns off the power supply when the input voltage is below $95V_{ac\ rms}$. At the same time, the microcontroller monitors the current through the LEDs. If the current falls below a certain level for a specified length of time and the input voltage is above the minimum during that time, i.e. at a time the lamp should be lit, the fuse blow out module is activated. The fuse blow out module uses a high power MOSFET to make a short between the active and neutral wire of the lamp, therefore melting the fuse. The whole cycle (detection, activation through fuse melting) takes less than a second. In another embodiment, the LEDs are arranged in independent strings. Comparators monitor the current through each string and activate the FBO when one or more string are out.

FIG*s*. 3A-D are a circuit diagram of the inventive power supply.

Figure 4:
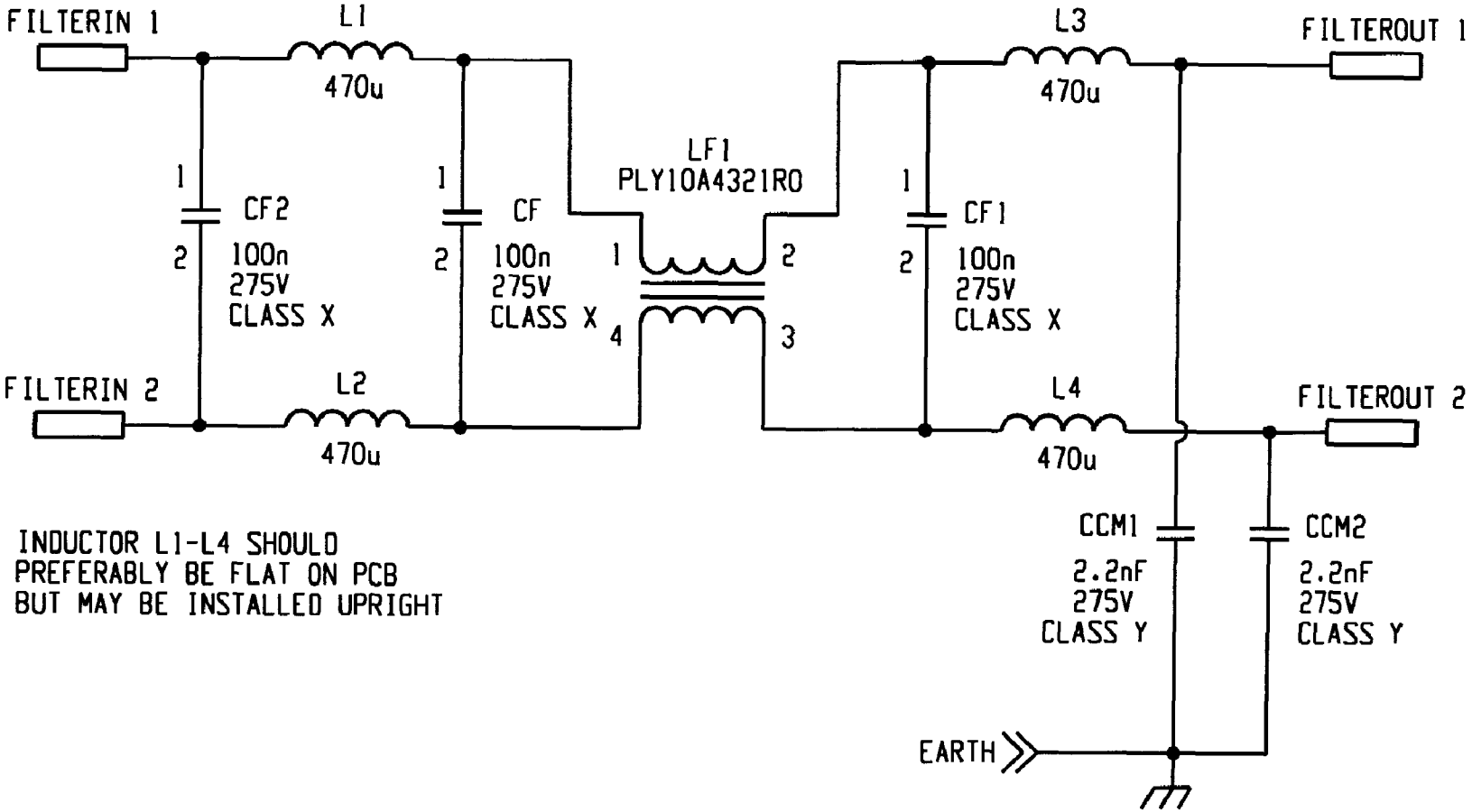
Figure 5A:
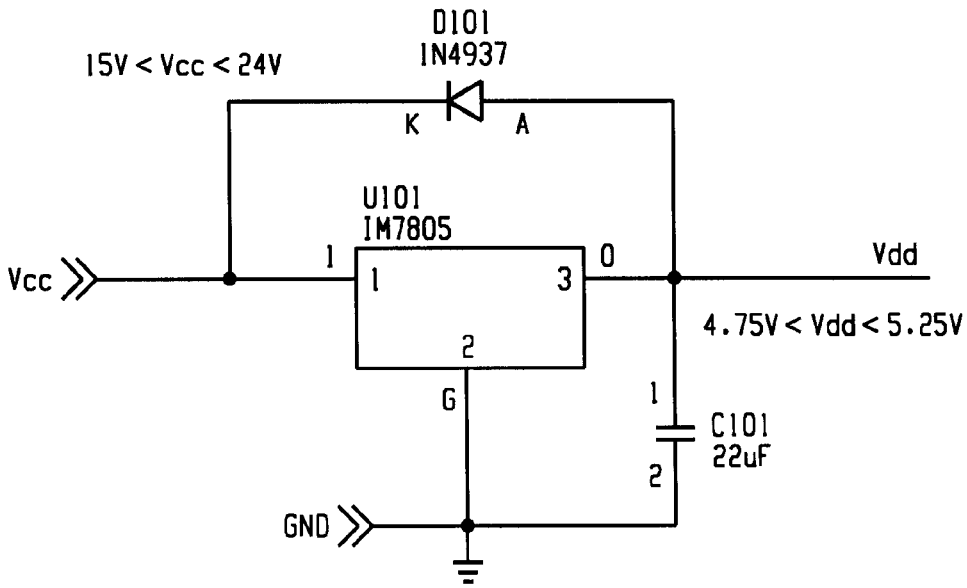
Figure 5B:
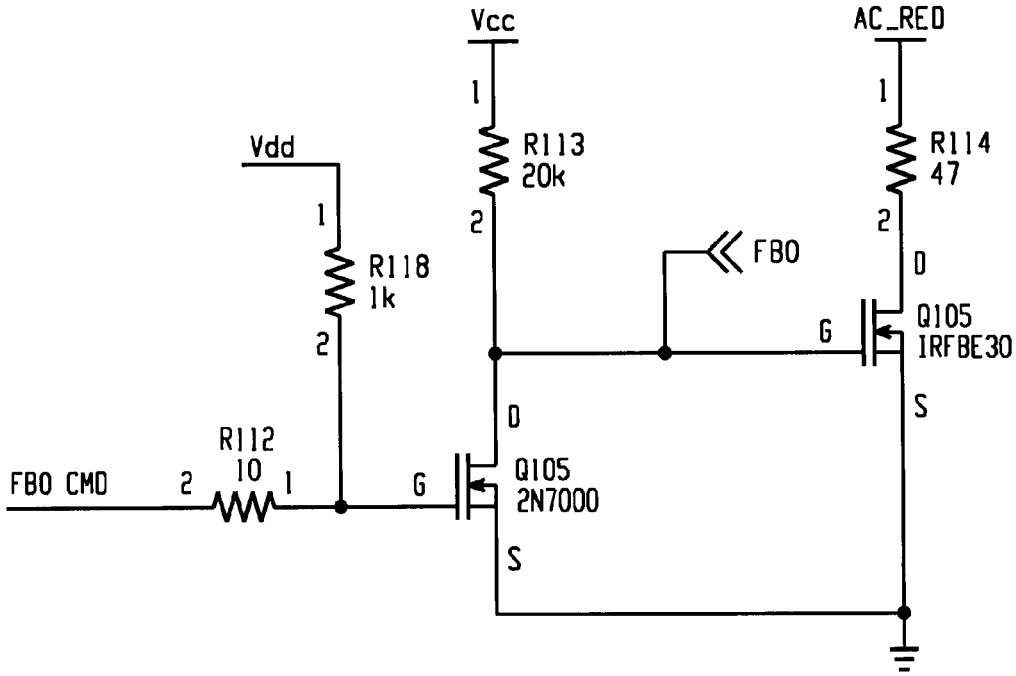
Figure 5C:
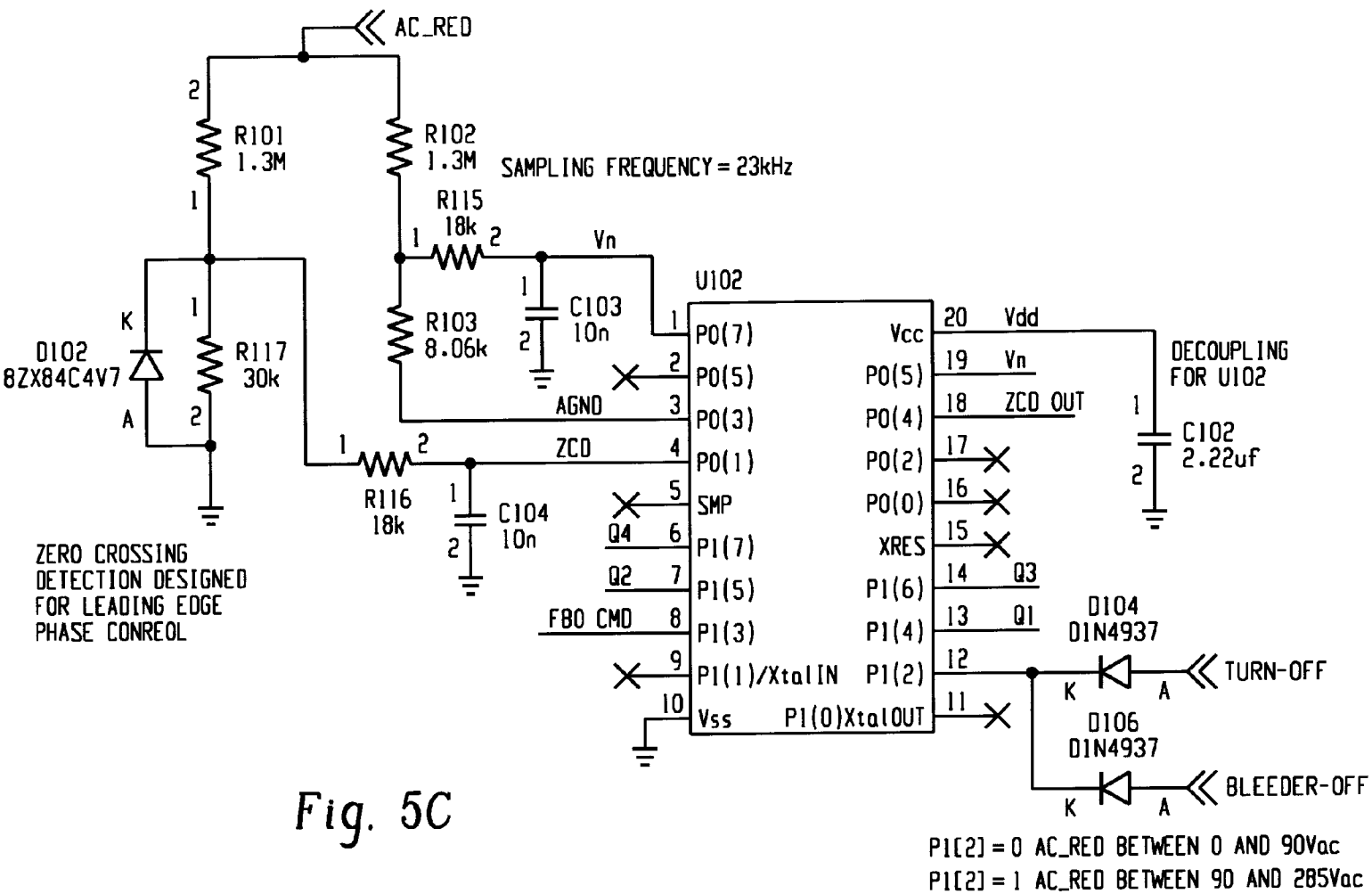
Figure 5D:
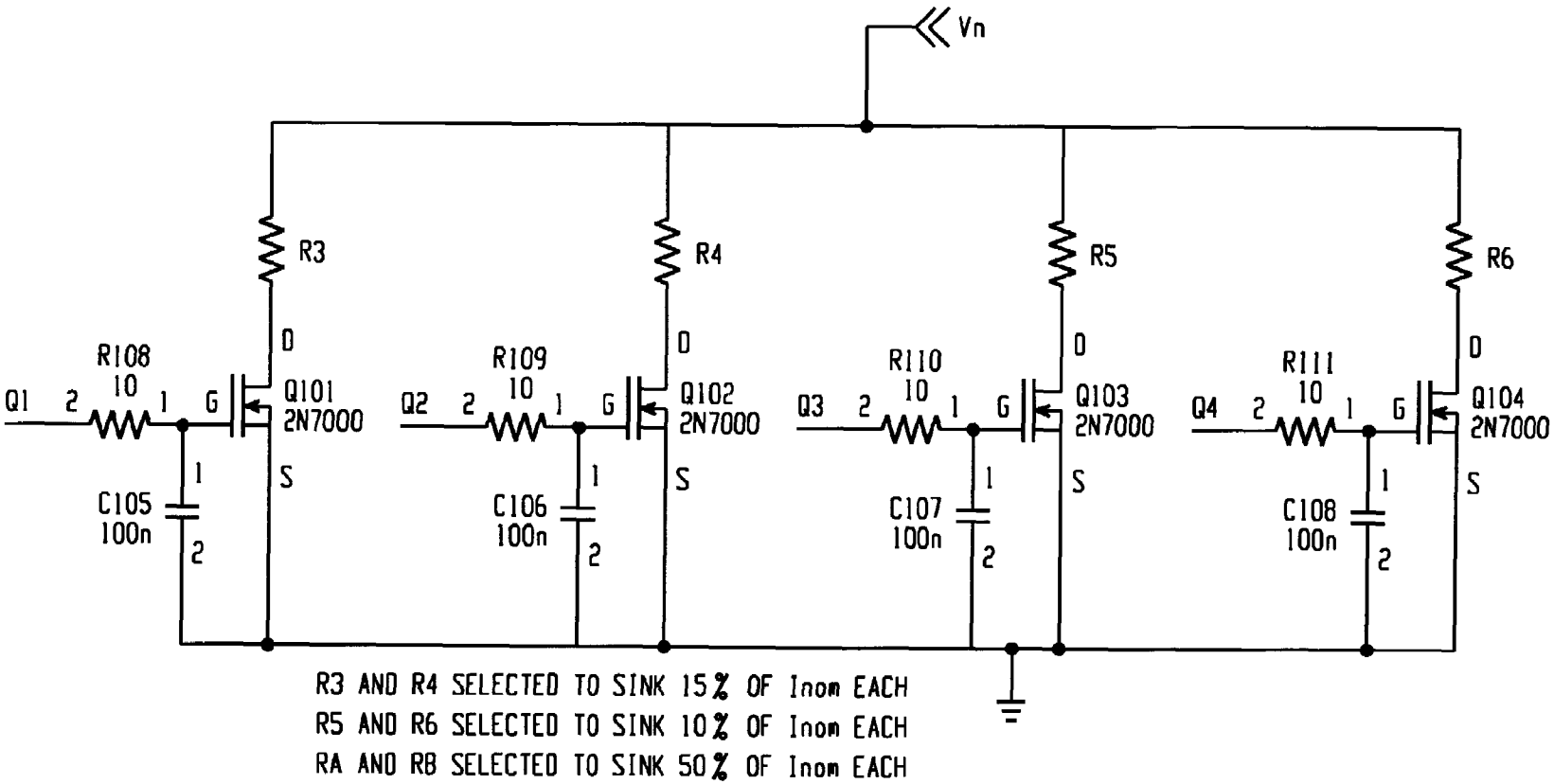

FIG. 4 is a detail view of the input filter circuit.

FIG. 5A-D are detail views of the modules.

Figure 6:
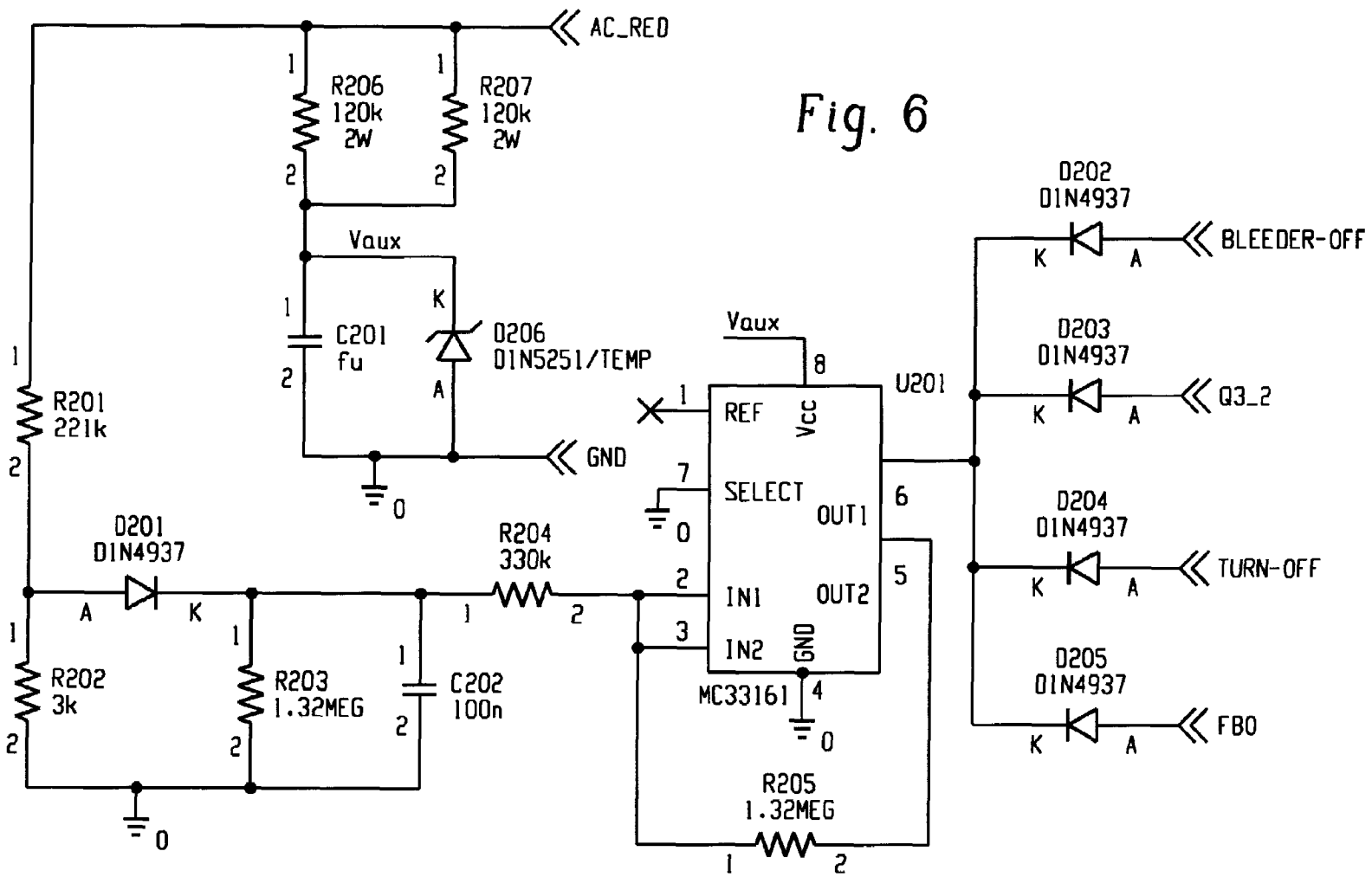

FIG. 6 is a detail view of an under-voltage lockout circuit.

DETAILED DESCRIPTION OF THE INVENTION

A LED traffic signal 10 comprises a housing 12, a power supply 14, wires 16, a printed circuit board 18, at least one LED 20 and an outer shell or cover 22. In addition, the signal 10 may include a mask (not shown) and/or optical element 24. For example, an arrow signal preferably uses an arrow shaped mask (not shown). Preferably, the housing is moisture and dust resistant. Preferably, the optical element 24 and outer shell 22 are made of UV stabilized polycarbonate.

Figure 1:
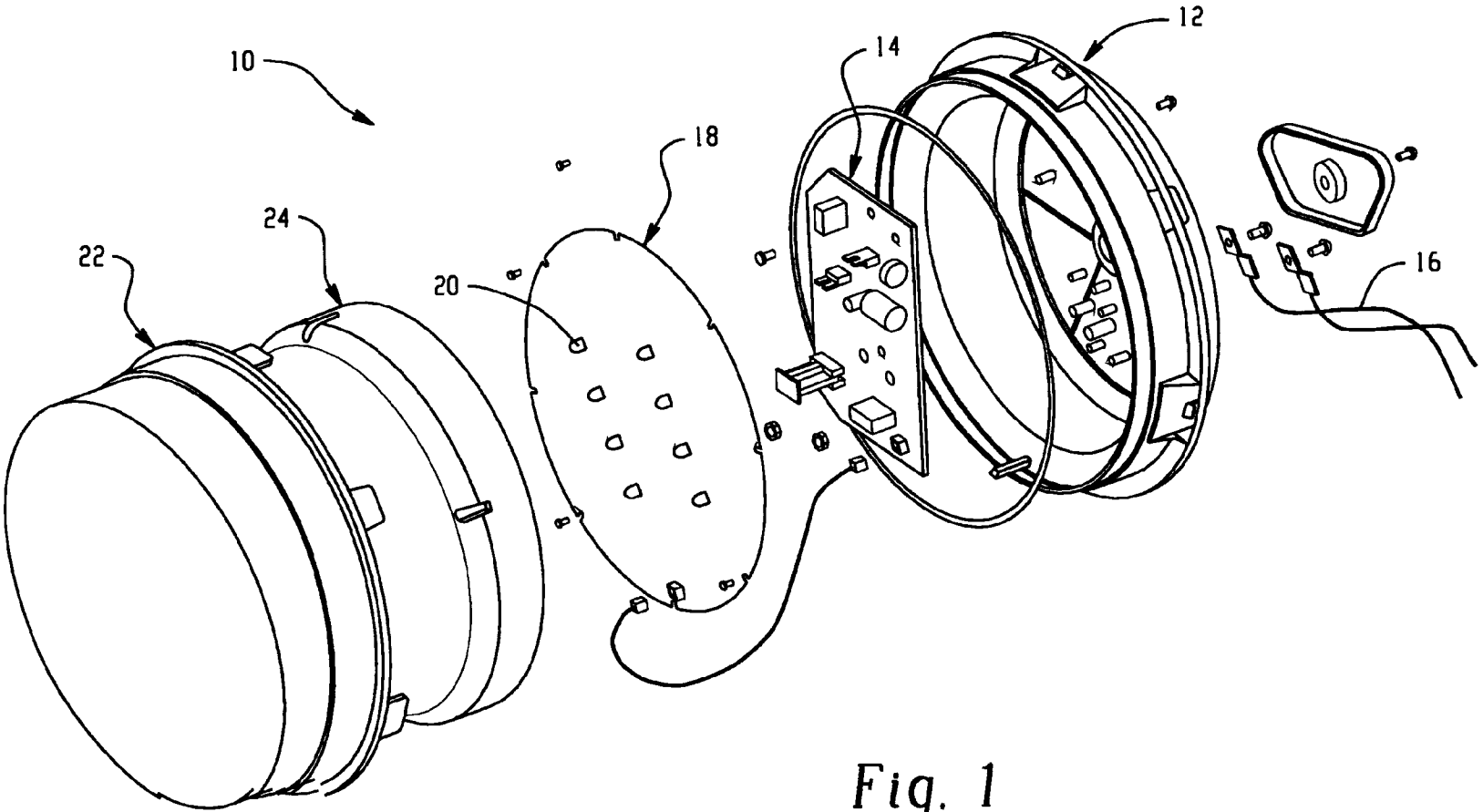
FIG. 1 is a LED signal lamp.
Figure 2:
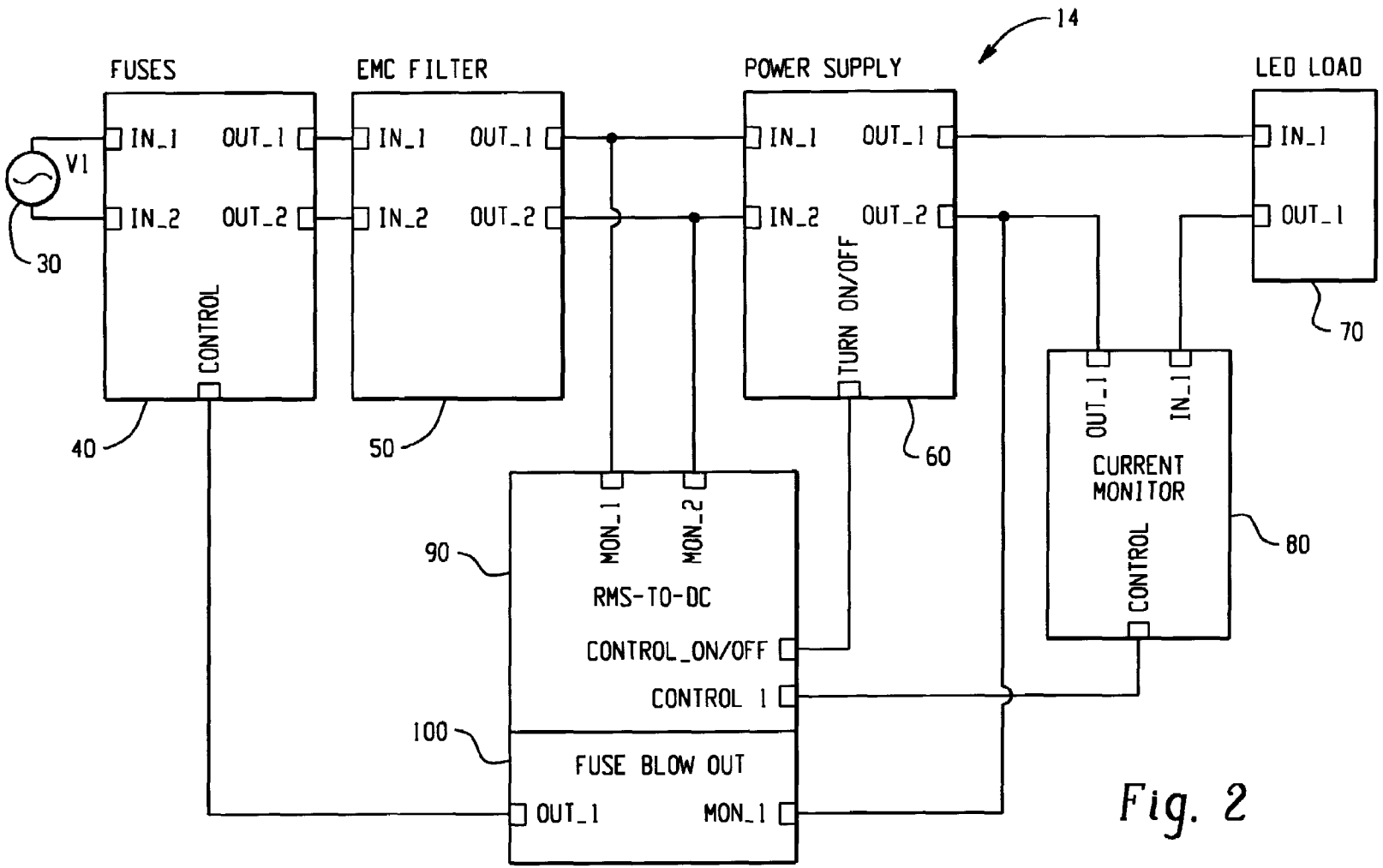
FIG. 2 is block schematic of the inventive power supply, showing the different functions.
Figure 3A:
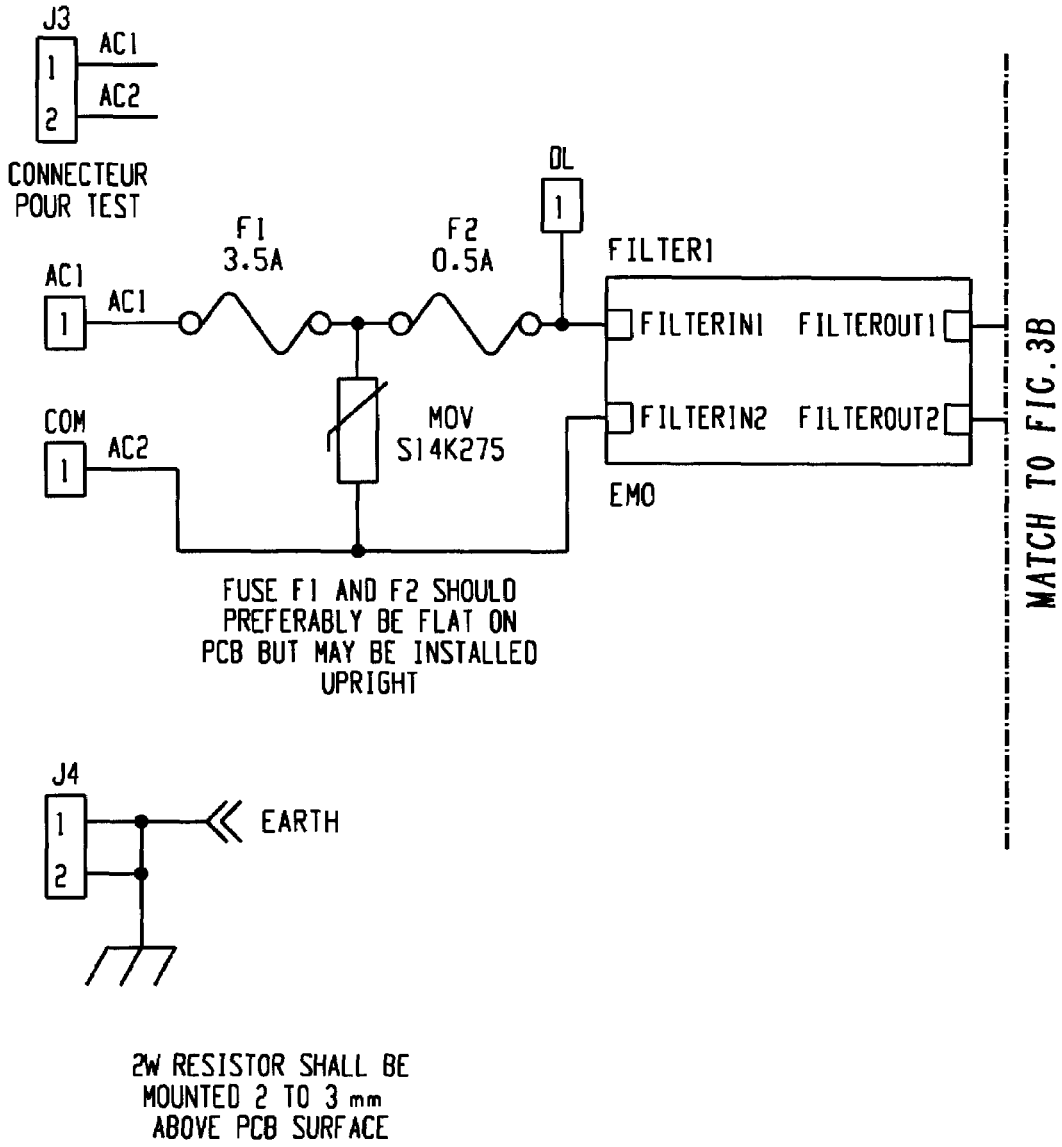
Figure 3B:
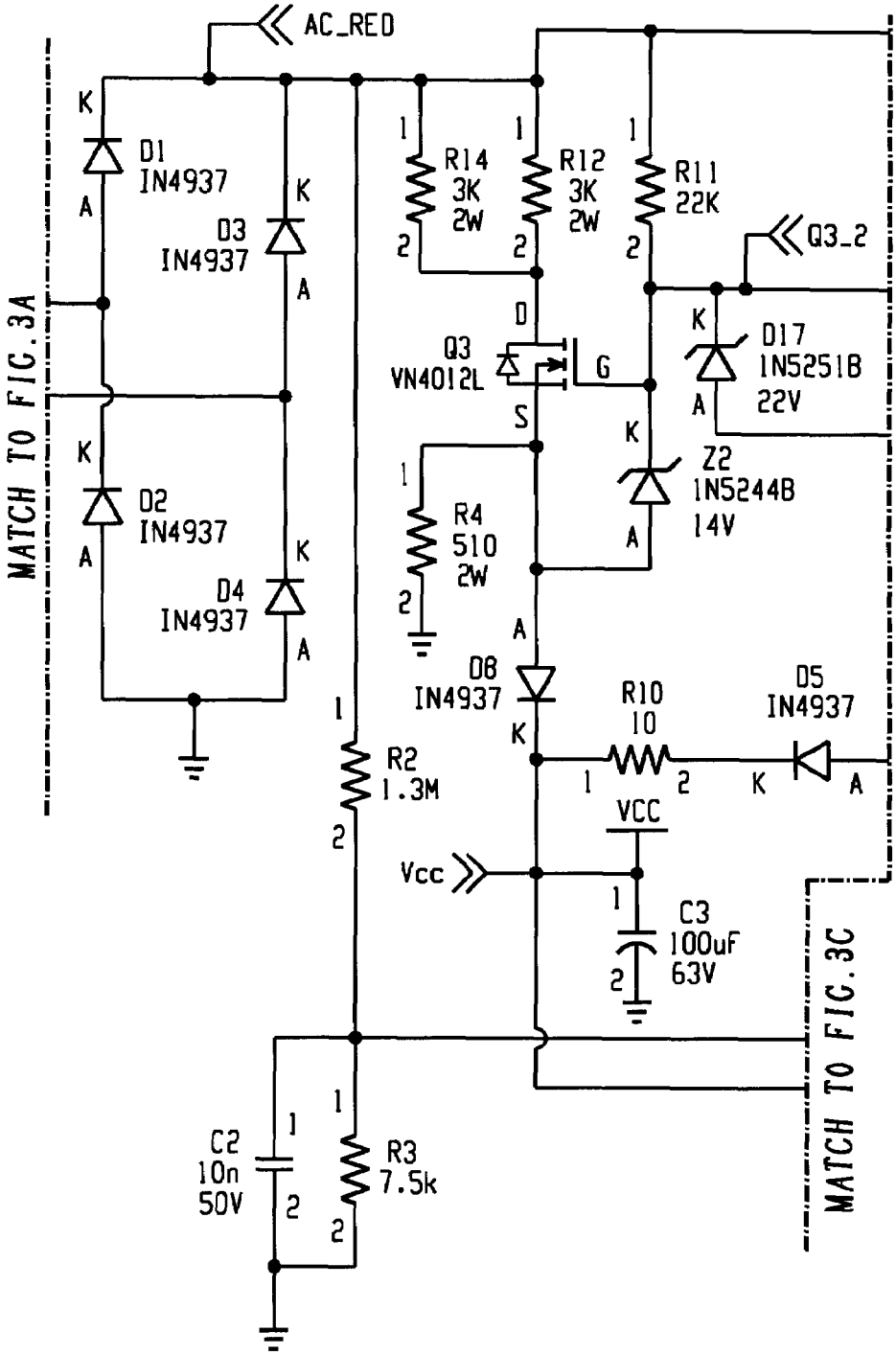
Figure 3C:
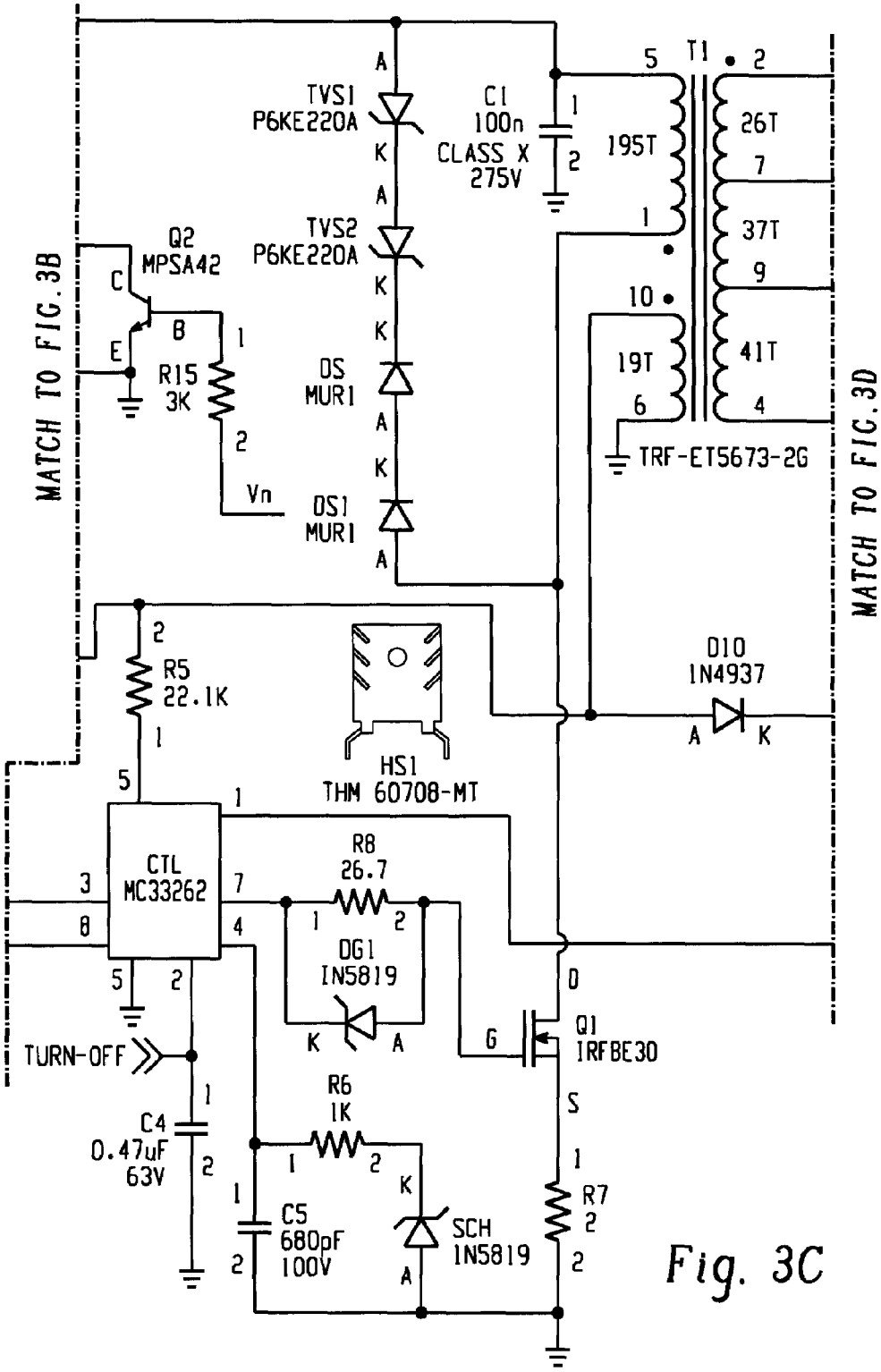
Figure 3D:
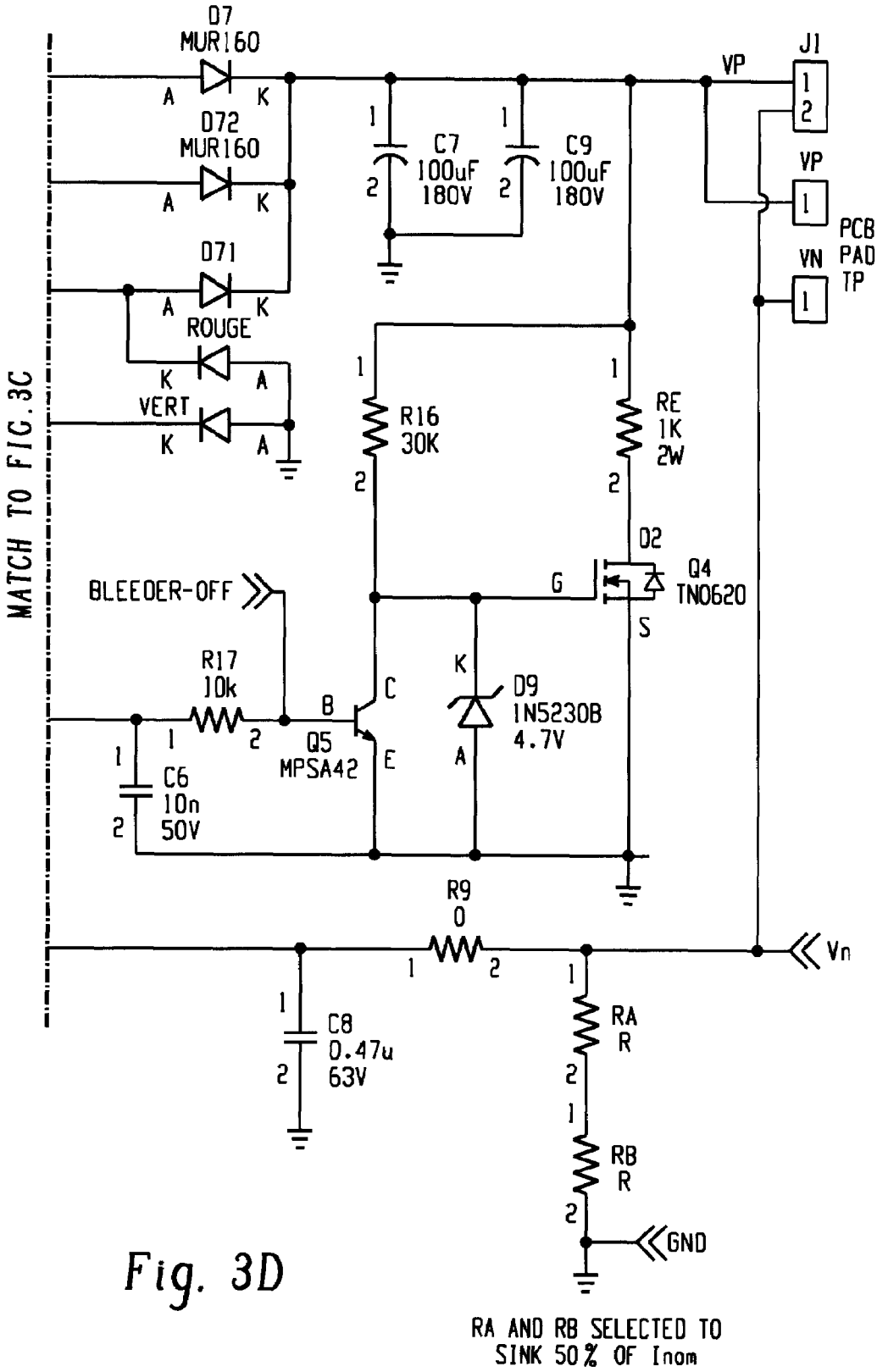

A block diagram of the power supply system 14 is shown in FIG. 2. Each module will be explained in detail below. The power supply system 14 includes a novel system to control the light intensity of a LED traffic signal 10 to conform to a predetermined pattern, depending on the input voltage root mean square (RMS) value. The input voltage is changed by acting on the amplitude of the sine wave or by using a triac and controlling the angle of fire. Preferably, the signal 10 operates at a voltage range of about 100 to about 285 V at 50 Hz AC. Preferably, the dimming range is about 200 to about 230 V.

The power supply 14 comprises the following modules: fuse module 40, electromagnetic compatibility (EMC) filter module 50, power supply module 60, LED load module 70, current monitor module 80, RMS-to-DC conversion module 90, and fuse blow out module 100.

The fuse module 40 contains the fuses (not shown) for the power supply circuit 60. The fuse module is directly connected to the fuse blow out module 100 and contains a device to protect the circuitry and the lamp from overvoltage on the AC line 30 coming into the lamp 10.

The EMC filter module 50 contains an arrangement of X2- and Y-capacitors, inductors and common mode chokes to reduce conducted electromagnetic emissions. All components are properly de-rated to ensure that the voltage or current applied is never above the manufacturer's rating. Filtering is necessary due to the noisy nature of a switching power supply.

The power supply module 60 takes the AC voltage from the AC input line 30 and transforms it into DC voltage, with a regulated current, to power the LEDs. A switching power supply is used. This power supply uses a flyback converter. The power supply supplies power to the load when the input voltage is between preferred $100V_{ac}$ and $285V_{ac}$. The power supply module has a variable duty cycle so that the signal coming from the current monitor is always the same.

The LED load module 70 comprises LEDs preferably in a series-parallel arrangement. If an LED suffers from a catastrophic failure, only the affected LED will shut down. The current will be equally spread among the remaining parallel LEDs. As a result, the remaining LEDs and, thus, the lamp will remain lit.

Metal core printed circuit boards are used for some lamps such as the yellow 300 mm disc and the yellow 300 mm arrow. Other lamps many use high quality glass epoxy printed circuit boards FR4.

The current monitor module 80 reads the current flowing through the LEDs and reports the value to the power supply micro-controller. The current monitor module 80 is acted upon by the RMS-to-DC module 90 to change the light intensity. The gain of the reading is modified to change the current flowing through the LEDs.

The RMS-to-DC module 90 and the fuse blow out 100 module incorporate a microcontroller that monitors the input voltage and the current flowing in the LEDs.

The input voltage is sampled at about 23 kHz. This sampling rate is capable of detecting a phase controlled signal that varies by as little as 1 degree at 60 Hz. The microcontroller preferably uses a true RMS-to-DC algorithm. Whatever the shape of the input voltage, the microcontroller computes the RMS value of the input voltage ($V_{rms}$) and averages it over a specified time. For example, the voltage may be sinusoidal or phase-controlled. In a phase-controlled voltage, a part of each sine wave is chopped, but the amplitude remains unchanged. The current monitor gain is adjusted to closely follow the intensity vs. $V_{rms}$ graph given in the AS/NZS 2144 standard. Based on the RMS value calculated, four transistors are turned off or on to control the current flowing the LEDs. In another embodiment, the micro-controller acts upon a voltage controlled current source. Preferably, the lamp 10 turns off when the voltage is less than 100 V ±10V. Even, more preferably, the lamp 10 turns off when the voltage is less than 100 V. Most preferably, the lamp 10 turns off when the voltage is less than 95V. More preferably, the micro-controller also turns off the power supply when the input voltage is below $95V_{ac\ rms}$. The micro controller preferably turns off the power supply when the input voltage falls below a certain point. Preferably, a transistor is used to shorten the signal of the PWM in this situation. Zero crossing detection is desired for leading edge phase control.

At the same time, the microcontroller monitors the current through the LEDs. If the current falls below a certain level for a specified length of time and the input voltage is above the minimum during that time, i.e. at a time the lamp should be lit, the fuse blow out module is activated. The fuse blow out module uses a high power MOSFET to make a short between the active and neutral wire of the lamp, therefore melting the fuse. The fuse blow out module is an active circuit whose role is to intentionally blow the input fuse upon sensing a lack of current to allow detection of the failed lamp by a remote system designed to monitor signals for incandescent lamps. The whole cycle (detection, activation through fuse melting) takes less than a second.

Resistors, R3 and R4, are selected to each sink 15% of a nominal current $I_{nominal}$. Resistors R5 and R6 are selected to each sink 10% of $I_{nominal}$. RA and RB are selected to sink 50% of $I_{nominal}$.

I claim:

1. A power supply for a light emitting diode (LED) traffic signal lamp comprising: a fuse module, an electromagnetic compatibility (EMC) filter module, a power supply module, a LED load module, a current monitor module, a RMS-to-DC conversion module, and a fuse blow out module.

2. The power supply of claim 1 wherein the fuse module comprises at least one fuse for the power supply circuit.

3. The power supply of claim 2 wherein the fuse module is connected directly to the fuse blow out module and further comprises a device to protect circuitry and the lamp from over-voltage on an AC line coming into the lamp.

4. The power supply of claim 1 wherein the EMC filter module comprises X2-capacitors, and/or Y-capacitors, and/or inductors and/or common mode chokes and said EMC filter is adapted to reduce conducted electromagnetic emissions.

5. The power supply of claim 1 wherein the power supply module is adapted to transform AC voltage from an input into DC voltage, with a regulated current.

6. The power supply of claim 5 wherein the power supply module comprises a switching power supply.

7. The power supply of claim 6 wherein the switching power supply comprises a flyback converter.

8. The power supply of claim 1 wherein the power supply module is adapted to operate within the operating range of the lamp from about $100V_{ac}$ to about $285V_{ac}$ at 50 $HZ_{ac}$.

9. The power supply of claim 1 wherein the power supply module has a variable duty cycle.

10. The power supply of claim 1 wherein the LED load module comprises at least one LED.

11. The power supply of claim 10 wherein the LED load module comprises a plurality of LEDs connected in a series-parallel arrangement.

12. The power supply of claim 10 wherein the LED load module comprises a plurality of LEDs connected in a series arrangement

13. The power supply of claim 10 wherein the at least one LED is mounted on a printed circuit board.

14. The power supply of claim 11 wherein the current monitor module is adapted to read a current flowing through the LEDs and reports the value to a power supply controller.

15. The power supply of claim 11 wherein the current monitor module is acted upon by the RMS-to-DC module to change light intensity of the LEDs.

16. The power supply of claim 14 wherein a gain of the reading is modified to change the current flowing through the LEDs.

17. The power supply of claim 11 wherein the RMS-to-DC module and the fuse blow out modules comprise a microcontroller that monitors an input voltage and a current flowing in the LEDs.

18. The power supply of claim 12 wherein the fuse blow out modules comprise comparators that monitor a current flowing in LEDs strings of the LED load module.

19. The power supply of claim 17 wherein the RMS-to-DC module is adapted to sample the input voltage at 23 kHz.

20. The power supply of claim 17 wherein the RMS-to-DC module is adapted to detect a phase controlled signal that varies by as little as 1 degree at 60 Hz.

21. The power supply of claim 17 wherein the microcontroller uses a true RMS-to-DC algorithm.

22. The power supply of claim 20 wherein the microcontroller is adapted to compute the RMS value of the input voltage ($V_{rms}$), to average $V_{rms}$ over a specified time, and to adjust the current monitor gain to closely follow a specified intensity vs. $V_{rms}$ graph.

23. The power supply of claim 17 wherein the RMS-to-DC module further comprises four transistors and said transistors are turned off or on to control the current flowing in the LEDs.

24. The power supply of claim 17 wherein the RMS-to-DC module further comprises a voltage controlled current source and said voltage controlled current source controls the current flowing through the LEDs.

25. The power supply of claim 17 wherein the microcontroller is adapted to turn off the power supply when the input voltage is below $95V_{ac\ rms}$.

26. The power supply of claim 17 wherein the microcontroller is adapted to monitor the current through the LEDs and if the current falls below a certain level for a specified length of time and the input voltage is above a minimum during that time, to activate the fuse blow out module.

27. The power supply of claim 1 wherein the fuse blow out module comprises a high power MOSFET adapted to create short between an active and a neutral wire of the traffic signal.

* * * * *